US010473315B2

(12) United States Patent
Riquè Rebull et al.

(10) Patent No.: US 10,473,315 B2
(45) Date of Patent: Nov. 12, 2019

(54) CONTROL DEVICE

(71) Applicant: SIMON, S.A.U., Barcelona (ES)

(72) Inventors: Andrià Riquè Rebull, Barcelona (ES); Clara Batiste Mayas, Barcelona (ES); Salvi Plaja Miró, Barcelona (ES); Miguel Gragera Gil, Barcelona (ES); Susana Díaz González, Barcelona (ES)

(73) Assignee: SIMON, S.A.U., Barcelona (ES)

( * ) Notice: Subject to any disclaimer, the term of this patent is extended or adjusted under 35 U.S.C. 154(b) by 0 days.

(21) Appl. No.: 16/306,448

(22) PCT Filed: May 30, 2017

(86) PCT No.: PCT/ES2017/070371
§ 371 (c)(1),
(2) Date: Nov. 30, 2018

(87) PCT Pub. No.: WO2017/207850
PCT Pub. Date: Dec. 7, 2017

(65) Prior Publication Data

US 2019/0226670 A1 Jul. 25, 2019

(30) Foreign Application Priority Data

Jun. 2, 2016 (ES) ..... 201630735

(51) Int. Cl.
*H05B 37/02* (2006.01)
*F21V 23/04* (2006.01)
(Continued)

(52) U.S. Cl.
CPC ..... *F21V 23/0485* (2013.01); *H01H 23/006* (2013.01); *H01H 23/025* (2013.01);
(Continued)

(58) Field of Classification Search
None
See application file for complete search history.

(56) References Cited

U.S. PATENT DOCUMENTS

2011/0316441 A1* 12/2011 Huynh ..... H05B 33/0845 315/291
2012/0318657 A1 12/2012 Hoffknecht
2014/0265640 A1* 9/2014 Ruff ..... H01H 9/0271 307/139

FOREIGN PATENT DOCUMENTS

DE 102010024776 A1 12/2011
WO 2007150058 A2 12/2007

OTHER PUBLICATIONS

International Preliminary Report on Patentability dated Jun. 12, 2018 re: Application No. PCT/ES2017/070371, pp. 1-16, citing: US 2012/318657 A1, WO 2007/150058 A2, US 2014/265640 A1 and DE 10 2010 024776 A1.

(Continued)

*Primary Examiner* — Dedei K Hammond
(74) *Attorney, Agent, or Firm* — Cantor Colburn LLP

(57) ABSTRACT

Controlling device for controlling a lighting system including at least one light fitting, where said controlling device is linked to said lighting system, and where the controlling device includes a switching mechanism intended to turn on and turn off the lighting system, an adjusting mechanism intended to adjust the light intensity of the lighting system, and an interface, able to be actuated by a user in order to control the turning on and turning off, as well as adjust the light intensity.

10 Claims, 1 Drawing Sheet

(51) Int. Cl.
*H01H 23/00* (2006.01)
*H01H 23/02* (2006.01)
*H01H 23/24* (2006.01)

(52) U.S. Cl.
CPC ..... *H01H 23/24* (2013.01); *H05B 37/0209* (2013.01); *H05B 37/0272* (2013.01); *H01H 2231/052* (2013.01); *H01H 2239/006* (2013.01)

(56) References Cited

OTHER PUBLICATIONS

International Search Report dated Nov. 27, 2017 re: Application No. PCT/ES2017/070371, pp. 1-3, citing: US 2012/318657 A1, WO 2007/150058 A2, US 2014/265640 A1 and DE 10 2010 024776 A1.
Wrritten Opinion dated Nov. 27, 2017 re: Application No. PCT/ES2017/070371, pp. 1-5, citing: US 2012/318657 A1 and WO 2007/150058 A2.

* cited by examiner

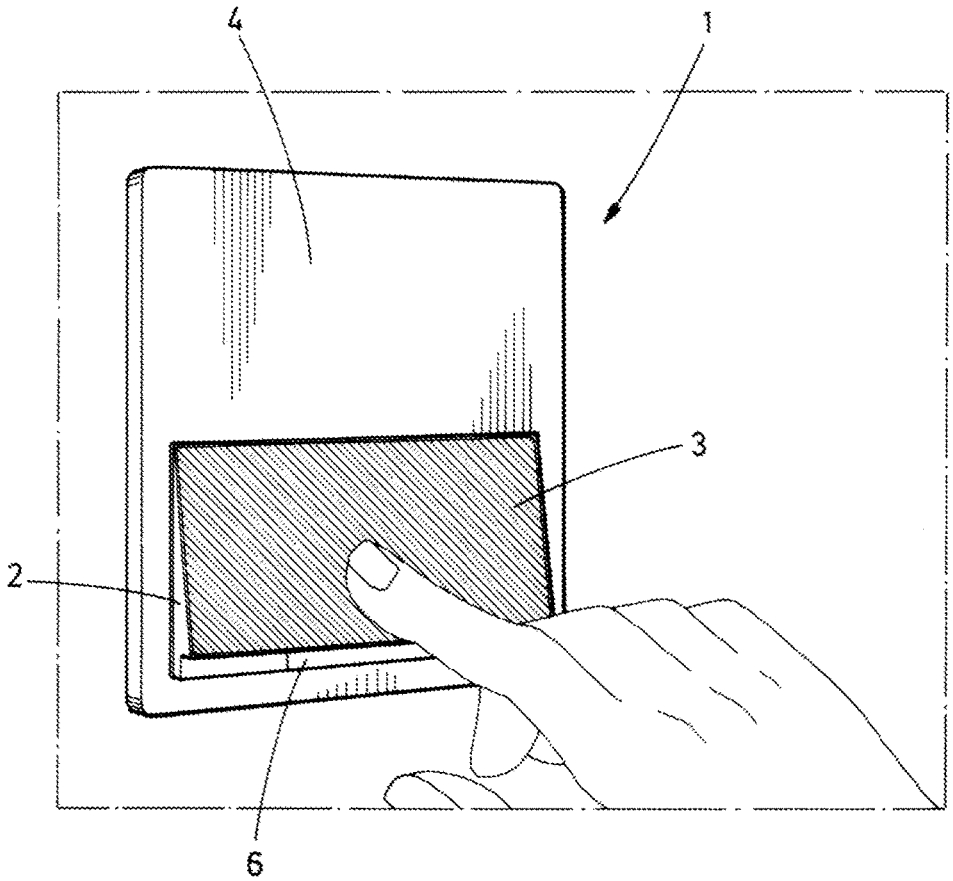
4
1
3
2
6

CONTROL DEVICE

TECHNICAL FIELD

The disclosure concerns a controlling device for the turning on, turning off and adjustment of the light intensity of a lighting system comprising at least one light fitting.

BACKGROUND

Currently, controlling devices are known that use an adjusting button connected to a potentiometer for controlling the light intensity level of a light fitting. Thus, a user can adjust the level of lighting by rotating said button. This button can be pressed by a user to turn on or turn off said light fitting. Additionally, this controlling device can have a control unit that can comprise memorized light levels.

Even though these devices function correctly, they penalize the control of the light intensity level compared to the turning on and turning off function, such that the user intuitively uses the device as a simple switching without using the light intensity control function.

Furthermore, these devices from the state of the art do not adjust and indicate the level of lighting at which the light fitting is set when it is turned off as well as turned on.

BRIEF SUMMARY

The present disclosure relates to a controlling device for controlling a lighting system comprising at least one light fitting, wherein said controlling device is linked with said lighting system and comprises:

- a switching mechanism linked to the light fitting and intended to turn the light fitting on and off,
- an adjusting mechanism comprising a control unit and is intended to adjust the light intensity of the light fitting, and
- an interface, linked to the switching mechanism and to the adjusting mechanism, able to be actuated by a user in order to control the turning on and turning off, as well as adjusting the light intensity.

Additionally, the controlling device comprises an electrical connection, heat dissipation elements and a casing that protects it and provides connection means for its integration in a box able to be flush-mounted, preferably, in a wall or in a surface box.

The switching mechanism and the adjusting mechanism are actuated by means of the actuation of the user on the same means, namely the interface of the controlling device. Preferably, this interface is the actuation surface of a rocker key.

More specifically, the switching mechanism comprises a switch with two states that allows for, according to the open or closed state thereof, the electrical powering of the lighting. The user, by means of applying a pressure to the interface, causes the switch between the open and closed states of the switching.

The interface comprises at least a sensor, and preferably comprises two sensors that are preferably capacitive sensors that are housed in the inner surface of the interface, such that the capacitive sensors occupy the majority of the inner surface of the interface. These two capacitive sensors are able to produce an essentially linear analog adjusting signal. This analog adjusting signal changes based on a linear movement parallel to the controlling device, performed by the user throughout the outer upper surface of the interface. The analog adjusting signal in each point of the length of the surface of the interface is related to a light intensity such that the actuation of the user on a point of the length of the surface of the interface makes it so that the capacitive sensors transmit to the control unit of the adjusting mechanism a signal that is determined and related to a specific light intensity.

It is worth noting that the control unit comprises a first microcontroller that in turn comprises at least an analog/digital converter for converting said analog adjusting signal to a digital one.

Thus, the first microcontroller transmits a digital signal so that the lighting system provides the light intensity according to this signal, in the case in which it is turned on or so that it has a starting light intensity when it is turned on.

It is worth noting that the actuation performed by the user on the interface can be by means of the contact on it or by means of the positioning thereof at a close distance approximately perpendicular to said surface.

Preferably, the interface additionally comprises an indicating mechanism linked to the adjusting mechanism and intended to continuously show the light intensity of the lighting system to the user.

This indicating mechanism comprises a plurality of LEDs also controlled by the control unit of the adjusting mechanism in order to be turned on linearly depending on the signal related to the light intensity provided by the capacitive sensors, the light system being turned on or turned off.

In a preferred embodiment, the indicating mechanism comprises means that cause signals such as sounds, scents, vibrations. . . .

Preferably the indicating mechanism is in the interface.

Preferably, the controlling device further comprises a wireless communication mechanism. More specifically, this wireless communication mechanism is linked to the first microcontroller of the control unit of the adjusting mechanism, and comprises a radio frequency antenna and a radio frequency module, the antenna being adjacent to the previously described capacitive sensor. In this way, the assembly of the capacitive sensor and the antenna occupy the entirety of the inner surface of the interface. Preferably, both are integrated in a PCB or directly printed on the inner surface of the interface, more preferably they are printed on the inner surface of the actuation surface of a rocker key or are integrated in a PCB affixed to the inner surface of the actuation surface of the rocker key.

In the preferred embodiment in which the interface is the actuation surface of a rocker key, the communications module is preferably housed on the inside of the rocker key.

Preferably, the wireless communication module is connected to the control unit of the adjusting mechanism in order to enable the communication thereof with external mechanisms.

In a preferred embodiment of the disclosure, the interface is the actuation surface of an interchangeable rocker key that can connect and disconnect from a module integrated in the wall that comprises the switching and the electrical connections.

Thus, the present disclosure enables using the entirety of the surface of the interface both for adjusting the light intensity and for turning the light fitting on and off, integrating a functional portion like the antenna of the communication module and the sensors in an ornamental portion diminishing the size of the device.

Furthermore, the present disclosure enables adjusting and indicating the light intensity of the light fitting if it is turned on, and enables adjusting and indicating the starting light intensity while it is turned off.

BRIEF DESCRIPTION OF THE DRAWINGS

As a complement to the description provided herein and for the purpose of helping to make the characteristics of the disclosure more readily understandable, in accordance with a preferred practical embodiment thereof, said description is accompanied by a set of drawings constituting an integral part of the same, which by way of illustration and not limitation represent the following:

FIG. 1.—Shows a schematic view of the connecting device.

DETAILED DESCRIPTION

The present disclosure, as shown in FIG. 1, relates to a controlling device (1) for controlling a lighting system, not shown, comprising at least one light fitting, wherein said controlling device (1) is linked with said lighting system and comprises:

- a switching mechanism, not shown, linked to the lighting system and intended to turn the lighting system on and off.
- an adjusting mechanism comprising a control unit and is intended to adjust the light intensity of the light fitting, and
- an interface, by way of actuation surface of a rocker key (2) preferably surrounded by a frame (4), linked to a switching mechanism and to an adjusting mechanism, able to be actuated by a user in order to control the turning on and off, as well as adjusting the intensity of the lighting.

The switching mechanism comprises a switch with two states that enables, according to the open or closed state thereof, the electrical powering of the lighting. More specifically, the switch is housed in an internal block of the controlling device (1), such that the state thereof depends on whether or not the rocker key (2) presses it, and in turn on whether or not the user has pressed said rocker key (2). Additionally, this internal block comprises the electrical connections with the light fitting and a casing that protects it.

The rocker key (2) comprises an outer surface (3) that is the interface of the controlling device (1) intended to receive the contact of the user, for example by means of the hand, a finger of a user or similar, for controlling the turning on and off of the light fitting, as well as for adjusting the intensity of the lighting.

More specifically, on the inside of the rocker key (2) a first printed circuit of polyamide with a thickness of 70 um is inserted which approximately occupies the entirety of the surface thereof. This printed circuit comprises an adjusting mechanism made up of two capacitive sensors and a radio frequency antenna, which makes up part of a wireless communication mechanism that further comprises a radio frequency module.

Alternatively, both the capacitive sensors and the radio frequency antenna are printed in the inner surface of the rocker key (2).

Thus, the user, upon sliding the hand, the finger or similar over said outer surface from one end towards the opposite end, usually from the left edge towards the right one, the capacitive sensors create, preferably, an analog adjusting signal, the value of which is increasing or decreasing depending on the movement and which is sent to an adjusting mechanism control unit.

More specifically, the capacitive sensors connect to the control unit comprising a first microcontroller endowed with an analog/digital converter that converts the analog adjusting signal into a digital one and processes it. Thus, the control unit enables, or interferes in, the passage of electrical current for determining the light intensity of the lighting system for all kinds of light fittings (reactive, capacitive or inductive).

Optionally, said radio frequency module of the communication mechanism manages the communications made by means of the radio frequency antenna with external elements by means of the Z-Wave protocol.

Preferably, the first microcontroller is inserted in the first printed circuit. Alternatively, it is inserted in a second printed circuit and linked to the first printed circuit by means of strips. This second printed circuit is housed in the rocker key (2).

Alternatively, this second printed circuit is housed in the internal block of the controlling device (1).

Additionally, this rocker key (2) in the outer surface thereof, in other words in the interface, comprises an indicating mechanism (6). This indicating mechanism (6) indicates to the user, regardless of whether the light fitting is turned on or off, the light intensity level of the light fitting, and is controlled by the first microcontroller comprised in the control unit.

Specifically, the indicating mechanism (6) comprises a series of LEDs arranged in a line, wherein a greater number of turned-on LEDs indicates a greater light intensity level of the light fitting from a minimum value to a maximum value.

More specifically, and in a non-limiting manner, the first microcontroller achieves that, upon sliding a finger over the surface of the interface from the left edge towards the right one, a first LED lights up and increases the intensity thereof until reaching a limit value that would be maintained at the same time as the intensity of the second LED also increases towards the limit value according to the movement of the finger passing along the surface of the rocker key (2), and in this way successively until the finger stops, or the last LED is lit up.

Additionally, the first microcontroller achieves that, when the lighting system is turned off, with the closeness or the contact of the user on the surface, the corresponding LEDs turn on indicating the starting intensity of the lighting system if the light fitting were turned on in that moment. Upon sliding the hand, the finger or similar from this starting intensity point towards one side or the other, the LEDs turn on or turn off, and correspondingly the intensity thereof is increased or decreased until the point in which the finger of the user stops.

Optionally, the wireless communication mechanism comprises a Wi-Fi type communications module.

The invention claimed is:

1. A controlling device for controlling a lighting system comprising at least a light fitting, wherein said controlling device is linked to said lighting system, wherein the controlling device comprises:

- a switching mechanism linked to the lighting system and intended to turn the lighting system on and off;
- an adjusting mechanism comprising a control unit intended to adjust the light intensity of the lighting system; and
- an interface, linked to the switching mechanism and to the adjusting mechanism, the interface being the actuation surface of a rocker key having a rotation axis, able to be actuated by a user in order to control the turning on and turning off, by means of applying a pressure to the interface as well as adjusting the intensity of the lighting; the interface comprising at least a sensor that transmits a signal that is determined and related to a specific light intensity to the control unit of the adjusting mechanism.

2. A controlling device according to claim 1 wherein the sensor is arranged parallel to the rotation axis of the rocker key such that the light intensity is controlled by means of a linear movement parallel to the rotation axis of the rocker key.

3. The controlling device according to claim 1, wherein the interface additionally comprises an indicating mechanism linked to the control unit of the adjusting mechanism and intended to continuously show the light intensity of the lighting system to the user regardless of whether or not it is turned on or turned off.

4. The controlling device according to claim 3, wherein the sensor is arranged parallel to the rotation axis of the rocker key such that the light intensity is controlled by means of a linear movement parallel to the rotation axis of the rocker key, and the indicating mechanism comprises a plurality of LEDs controlled by said control unit of the adjusting mechanism for being linearly turning on depending on the light intensity of the light fitting, it being turned on or turned off.

5. The controlling device according to claim 3, wherein the sensor is arranged parallel to the rotation axis of the rocker key such that the light intensity is controlled by means of a linear movement parallel to the rotation axis of the rocker key, and the indicating mechanism comprises a plurality of LEDs controlled by said control unit of the adjusting mechanism for being linearly turning on depending on the light intensity of the light fitting, it being turned on or turned off, and the controlling device further comprising a wireless communication mechanism connected to the control unit of the adjusting mechanism in order to enable the communication with external mechanism; the wireless communication mechanism comprising a radio frequency antenna and a radio frequency module.

6. The controlling device according to claim 1, wherein the switching mechanism comprises a switch with two states that enables, according to the open or closed state thereof, the electrical powering of the lighting.

7. The controlling device according to claim 1, wherein the interface comprises at least a capacitive sensor that substantially covers all of the inner surface thereof.

8. The controlling device according to claim 1, wherein the switching mechanism comprises a switch with two states that enables, according to the open or closed state thereof, the electrical powering of the lighting, and the interface comprises two capacitive sensors that substantially cover all of the inner surface thereof and that are able to produce an essentially linear analog adjusting signal depending on a linear movement made by the user on the outer surface of the interface.

9. The controlling device according to claim 1, wherein the interface comprises at least a capacitive sensor that substantially covers all of the inner surface thereof and the control unit comprises a first microcontroller that in turn comprises at least one analog/digital converter for converting said analog adjusting signal to a digital one.

10. The controlling device according to claim 1, wherein it further comprises a wireless communication mechanism connected to the control unit of the adjusting mechanism in order to enable the communication with external mechanisms.

* * * * *